United States Patent [19]

Sasaki

[11] Patent Number: 4,921,730

[45] Date of Patent: May 1, 1990

[54] METHOD OF PRODUCING A RECYCLED ASPHALT MIXTURE

[75] Inventor: Hideo Sasaki, Ageo, Japan

[73] Assignee: Taisei Road Construction Co., Ltd., Tokyo, Japan

[21] Appl. No.: 186,087

[22] Filed: Apr. 25, 1988

Related U.S. Application Data

[62] Division of Ser. No. 87,792, Aug. 21, 1987, Pat. No. 4,802,139.

[51] Int. Cl.[5] ..... B05D 5/10; E01C 5/12

[52] U.S. Cl. ..... 427/138; 106/281.1; 427/215; 427/403

[58] Field of Search ..... 427/136, 138, 215, 402, 427/403; 106/280, 281.1

[56] References Cited

U.S. PATENT DOCUMENTS

| | | | |
|---|---|---|---|
| Re. 30,685 | 7/1981 | Mendenhall | 106/281.1 |
| Re. 31,905 | 6/1985 | Mendenhall | 106/281.1 |
| 1,991,319 | 2/1935 | Finley | 106/280 |
| 2,572,068 | 10/1951 | Sommer | 427/138 |
| 3,513,005 | 5/1970 | Bradshaw et al. | 106/280 |
| 4,000,000 | 12/1976 | Mendenhall | 106/280 |
| 4,177,080 | 12/1979 | Mendenhall | 106/281.1 |

*Primary Examiner*—Sadie Childs

*Attorney, Agent, or Firm*—Cushman, Darby & Cushman

[57] ABSTRACT

Disclosed are a method of and an apparatus for producing a heated recyled asphalt mixture, in which a new material and a normal-temperature waste material, the water content of which is set at a limited range of values, are adapted to be mixed together in the ratio of (90 to 40):(10 to 60) in terms of weight. The temperature of heating the new material by means of a dryer is controlled to range from 190° C. to 350° C. so as to be in conformity with the above mixing weight ratio. Both the materials are mixed and kneaded together in a mixer at a kneading temperature of 150° C. or more. The gas generated within the mixer is exhausted toward a chimney in a state wherein the amount exhausted is made adjustable.

1 Claim, 3 Drawing Sheets

METHOD OF PRODUCING A RECYCLED ASPHALT MIXTURE

This is a division of application Ser. No. 087,792, filed Aug. 21, 1987, now U.S. Pat. No. 4,802,139, issued Jan. 31, 1989.

BACKGROUND OF THE INVENTION 1.(Field of the Invention)

The present invention relates to a method of and an apparatus for producing a heated recycled asphalt mixture, which are adapted to produce a recycled asphalt mixture by utilizing a waste asphalt pavement material produced following a remedy, etc. of an asphalt pavement.

2. (Description of the Prior Art)

A waste asphalt material which is produced as a result of remedy, repair, or the like of an asphalt-paved road has hitherto been attempted to be reused. Conventionally, a mixing system of drum-dryer type which is adapted to make much use of such waste asphalt material to an extent of 80 to 100 percent by weight was generally employed for that purpose. Such mixing system, however, has the following drawbacks. First of all, the system is expensive in respect of its equipment. Secondly, the asphalt material is deteriorated due to the reheating of the waste asphalt material by a flame or a high temperature air. This necessitates using a softening agent in order to increase the penetration. Besides, the waste asphalt material necessarily is stopped from being heated up to a required value of temperature, in order to prevent the asphalt material from being degraded. This results in production of a recycled asphalt mixture which is short of heating. Thus, the product becomes unstable in terms of property.

Further, in the prior art, when the waste material is kneaded while it is heated, a large amount of water contained therein is instantaneously vaporized. This causes generation of a gas containing a large amount of water and dust. The generation of such a gas contaminates the operating environment to become a cause of air pollution. As attempts to solve these problems, several techniques have hitherto been made public, which includes a production method and apparatus disclosed in Japanese Patent Unexamined Publication Nos. 117102/83 and 120757/85. Besides, a technique adjusting the internal pressure of the dryer to make stable the quality of an aggregate material delivered from the dryer has also been proposed in Japanese Patent Examined Publication No. 53963/84.

The techniques which are disclosed in Japanese Patent Unexamined Publications Nos. 117102/83 and 120757/85 each features heating of only a new material by means of a dryer with a waste material being introduced at room temperature and at a relatively low mixing rate of weight. Further, the former technique of No. 117102/83 is also characterized by causing a gas generated at the time of kneading the new material and the waste material to be exhausted towards the chimney side by way of a duct. On the other hand, the latter technique of No. 120757 also has a feature in respect of a blade structure within the dryer for heating the new material in addition to controlling a mixing weight ratio between the new and waste materials, as above. Any of the above-mentioned old techniques, however, made no attempt to combine or synthesize a part or all of such techniques, although it has its own features. Further, no disclosure has yet been made of a technique which is based on the consideration of an optimum weight percentage for mixing of the waste material, water content in the waste material, etc.

SUMMARY OF THE INVENTION

Accordingly, the object of the present invention is to provide a method of and an apparatus for producing a heated recycled asphalt mixture, which excels the advantages of the prior art, and in which the mixing ratio in terms of weight between waste and new materials is selected to fall within an optimum range while the water content in the waste material is kept at a limited range of values, so as to stabilize the quality of the resulting recycled asphalt mixture; and, on the other hand, reduction in the installation cost can be achieved, elimination of causes of the air pollution is fulfilled and, at the same time, the improvement in quality of the mixture is made through controlling the temperature of heating the new material within a dryer to a value which permits it to be commensurate with said mixing ratio.

To attain the above object, according to the present invention, there is provided a method of producing a heated recycled asphalt mixture, which is adapted to cause a base material to be recycled and a new material to be mixed together in a mixer to produce a heated recycled asphalt mixture, the former material being prepared by crush/breakage and subsequent classification from a waste asphalt pavement material composed of filler bitumen and aggregate material, and the latter material being composed of crushed or broken stones, sands, asphalt, normal-temperature filler, etc., said latter material being heated by a dryer up to an optimum temperature and introduced into the mixer, the method comprising the steps of selectively determining the mixing ratio of new aggregate composed of crushed stones, sands, etc. contained in the new material to the base material to be recycled from the ranges of (90 to 40):(10 to 60) in terms of weight, setting the heating temperature for the new aggregate such that when the weight of the new aggregate is selected to be 90 percent, it is set at approximately 190° C. and that, as the weight of the new material is selected to be a smaller value toward 40 percent, it is sequentially raised from 190° C. toward 350° C., the base material being maintained at all times at normal temperature while its water content is suppressed to 2 percent or less, mixing the new aggregate and the base material to be recycled in the mixer while both the materials are maintained to have a temperature of 150° C. or more by way of heat exchange therebetween, thereby causing part of the filler bitumen in the base material to be recycled to be transferred onto the surfaces of the new aggregate to thereby perform a primary coating, subsequently introducing new filler and new heated asphalt into the mixer, and kneading together the new aggregate, base material to be recycled, new filler, and new asphalt, thereby causing the new filler bitumen to be transferred onto the surfaces of the new aggregate and base material to be recycled to thereby perform a secondary coating.

Further, according to the present invention, there is provided an apparatus for producing a heated recycled asphalt mixture, improved from an asphalt plant of batch system comprising a new-aggregate handling means including a supply means, a dryer, a sieving means, a storage means and a measuring tub means, a new-asphalt handling means including a supply means and a measuring tub means, a new-stone-powder handling means including a supply means and a measuring tub means, a mixer for mixing with each other a new aggregate, new asphalt and new stone powder, exhaust ducts connected to the dryer, sieving means and mixer, and a bag filter and a cyclone collector for collecting dusts from the associated ducts by use of exhausters, the apparatus comprising a base-material-to-be-recycled handling means including a supply means, a storage means, a measuring means, and an introduction- into-the-mixer means, the base material to be recycled being prepared by crush/breakage and subsequent classification from a waste asphalt pavement material, the dryer having therein a heated hopper section constituting an aggregate discharge section, the heated hopper section having a corner at which the gas is most likely to stagnate and at which there is disposed a pressure sensor for controlling a pneumatic pressure, whereby the rate at which the gas is exhausted by means of the exhauster is made variable and controlled in accordance with the operation of the pressure sensor so as to cause the internal pressure of the dryer to be maintained at a constant level in corresponding relationship to the amount of combustion gas fed into the dryer from a burner thereof and the amount of vapor generated from the new aggregate therein, the level being substantially the same as that of the pneumatic pressure prevailing outside the dryer and indicating a water column of minus one to several millimeters when numerically expressed, the dryer being in the form of a hollow cylinder extending from a raised aggregate introduction port to a lowered aggregate discharge port by way of an intermediate inclined portion where the new aggregate can be permitted to slide and shift toward the lowered discharge port while it is being revolved along an inner surface of the dryer, the dryer having disposed therein the burner in such a manner that a flame thereof is directed toward the aggregate introduction port from a central part of the cylindrical dryer in the vicinity of the aggregate discharge port thereof, the dryer having an inner wall surface section corresponding to a flame section of the burner, the inner wall surface section being provided with auxiliary blades having a shape permitting the new aggregate to be moved along the entire inner peripheral wall surface without hindering the advance of the flame of the burner, the dryer having another intermediate wall surface section located at a position remote from that corresponding to the flame section of the burner, the another intermediate inner wall surface section being provided with agitating blades permitting the new aggregate to be uniformly distributed over the entire cross-sectional zone of the cylindrical dryer, the dryer having a third inner wall surface section in the vicinity of the aggregate introduction port, the third inner wall surface section being provided with nonreturn blades capable of checking the backward flow of the new aggregate, the measuring tub means and mixer being covered by a covering means from which is led out the exhaust duct connected to the bag filter and the cyclone collector via the exhauster, the exhaust duct being provided at its intermediate portion with an automatic opening/closing mechanism constituted by a damper as well as a blower mechanism.

The present invention adopts an asphalt mixing system of batch type which is small in the installation cost and which does not necessitate the use of any softening agent or the like to provide a product of stable quality, the invention being characterized in that the waste material is introduced at normal temperature while the rate at which it is introduced for being mixed with the new material is comparatively small. That is, the invention has the following features. The new material and the normal-temperature waste material, the water content of which is set at a limited range of values, are adapted to be mixed with each other in the ratio of (90 to 40):(10 to 60) in terms of weight. On the other hand, the temperature of heating the new material by means of the dryer is controlled to range from 190° C. to 350° C. so as to be in conformity with the above mixing weight ratio. The new and waste materials are mixed and kneaded together in a mixer at a kneading temperature of 150° C. or more. The gas generated within the mixer is exhausted toward a chimney in a state wherein the amount exhausted is made adjustable. The heating temperature inside the dryer is controlled by causing the internal pressure of the latter to be kept at a level substantially the same as that of the external pressure and, to this end, discharging the exhaust gas within the dryer toward the chimney in a state wherein the amount discharged is made adjustable. On the other hand, the blades of various configurations are provided on the inner peripheral surface of the dryer so as to enable the new material to be exposed to the flame with high efficiency.

DESCRIPTION OF THE PREFERRED EMBODIMENT

Figure 1:
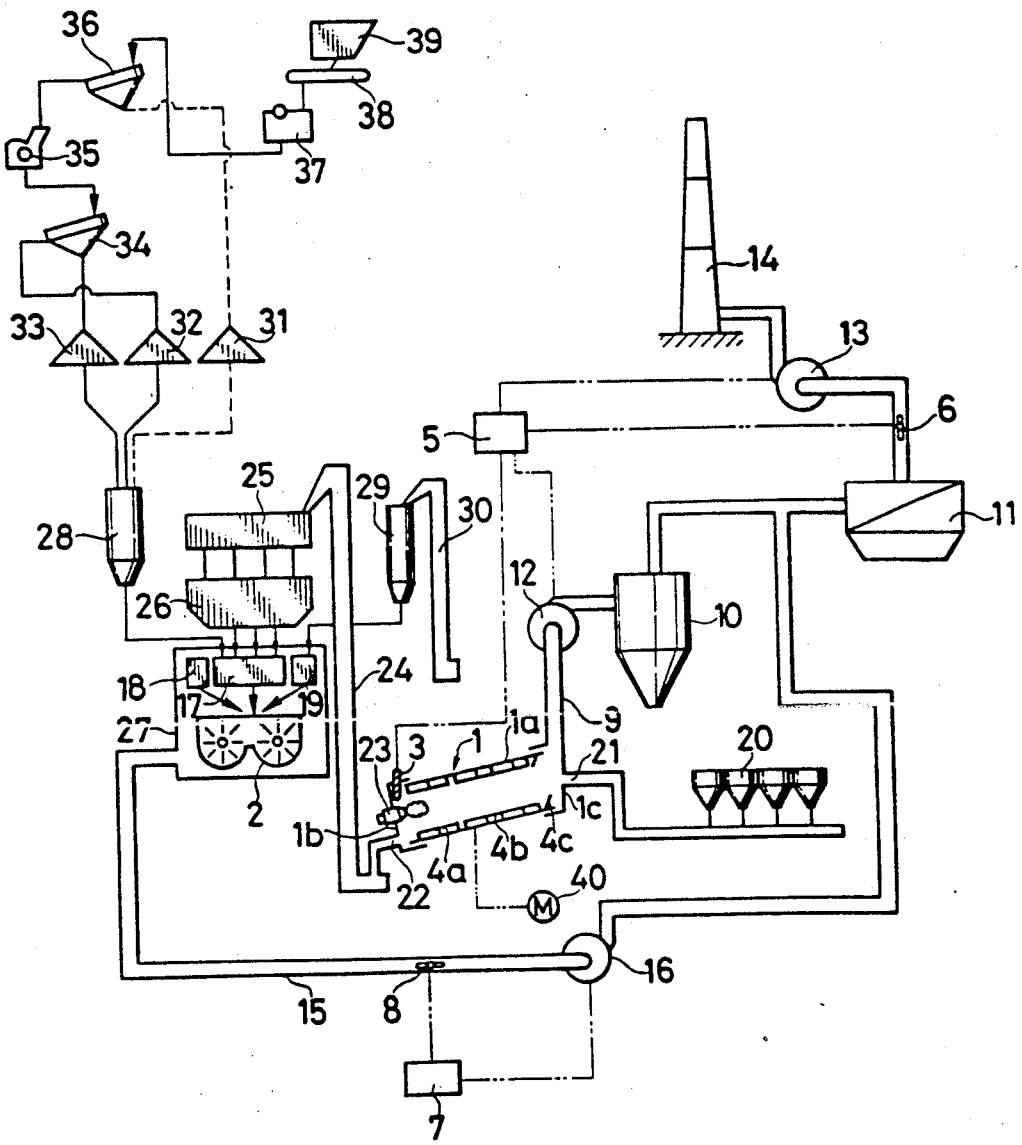
FIG. 1 is a view showing the entire structure of an embodiment of the present invention.

An apparatus for producing a heated recycled asphalt mixture will now be described with reference to the drawings.

An aggregate material to be recycled is prepared by crushing and breaking and subsequent classification from a waste asphalt pavement material. That is, the waste asphalt pavement material is conveyed by means of, for example, a truck not shown up to a storage tub 39. It is then carried by means of a conveyor 38 up to a jaw crusher 37 in which it is crushed into pieces. Of these pieces, the large ones which have been obtained by way of a sieving device 36 are further crushed by means of an impact crusher 35 and then fed into a sieving device 34. The base material which has been obtained by way of the sieving devices 36 and 34 is classified according to the particle size. The base material thus classified is fed into buckets 31, 32 and 33 and then is fed into an aggregate receptacle 28 (waste material receptacle). Then, the aggregate material is fed into an aggregate measuring tub 17. On the other hand, new aggregate which is composed of crushed stones and sands is stored in an aggregate receptacle 20 in a state wherein it is classified. The new aggregate is then fed from the aggregate receptacle 20 into a dryer 1 in which it is heated up to a moderate temperature. Thereafter, the new aggregate is conveyed upwards by means of a bucket conveyor (not shown) disposed inside a heated elevator 24. The new aggregate material, thereafter, is fed into the aggregate measuring tub 17 via a shaking sieve 25 and a heated receptacle 26. The new aggregate material and the aggregate material to be reproduced have their respective weights so measured as to a predetermined mixing ratio as expressed in terms of weight.

The exhaust gas which contains the vapor and dusts generated within the dryer 1 is exhausted out of a chimney 14 by way of an exhaust duct 9 equipped with exhausters 12 and 13. The exhaust duct 9 is equipped with a cyclone 10 and a filter 11 which are intended to remove the dusts and the like from the exhaust gas.

On the other hand, stone powders are upwardly conveyed by means of a bucket conveyor not shown which is installed inside a stonepowder elevator 30. They are temporarily stocked in a stone-powder receptacle 29 and then are fed into a stone-powder measuring tub 19. Further, a new asphalt also is fed into an asphalt measuring tub 18. The mixture of the new aggregate and the base material to be recycled, both of which are blended at the later-described mixing weight ratio, and predetermined amounts of stone powders and asphalt are thrown into the mixer 2 and are heated and kneaded together with the latter. The mixer 2, the aggregate measuring tub 17, the asphalt measuring tub 18 and the stone powders measuring tub 19 are covered by a covering 27 and thus are received therein. The interior of the covering 27 is allowed to communicate with a duct 15 by connecting one end thereof to the covering 27. An opening/closing valve 8 and an exhauster 16 are equipped to the duct 15, the other end portion of which is allowed to communicate with the interior of the exhaust duct between the cyclone 10 and the filter 11. Another opening/closing valve 6 and another exhauster 13 are also equipped to another exhaust duct between the filter 11 and the chimney 14. To the opening/closing valve 6 is connected the amount-of-exhaust-gas controlling device 5, to which there is connected a pressure sensor 3 which constitutes a pressure sensing means. It is to be noted in this connection that the amount-of-exhasut-gas controlling device 5 is also connected with exhausters 12 and 13 so as to control the amount of gas exhausted. Further, an automatic opening/closing device 7 is connected to the opening/closing valve 8 as well as to the exhauster 16 so as to control the degree of opening as well as the number of rotations.

Next, the general description of the structure of the dryer 1 will now be described below.

Figure 2:
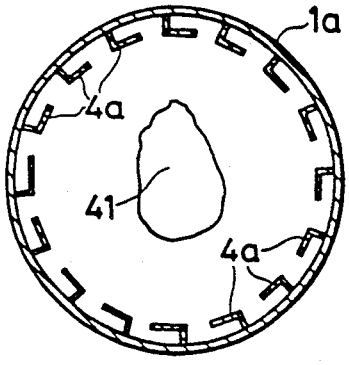
FIG. 2 is a cross sectional view showing the shape of auxiliary blades provided on the inner peripheral wall surface of a flame section of cylindrical dryer.
Figure 3:
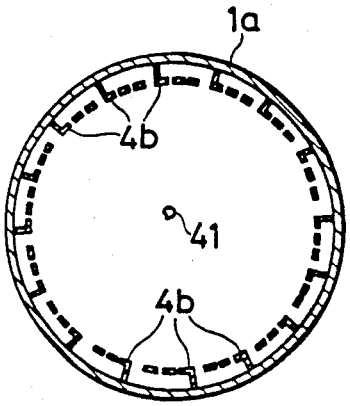
FIG. 3 is a cross sectional view showing the shape of agitating blades provided on the inner peripheral wall surface of an intermediate section of the cylindrical dryer.
Figure 4:
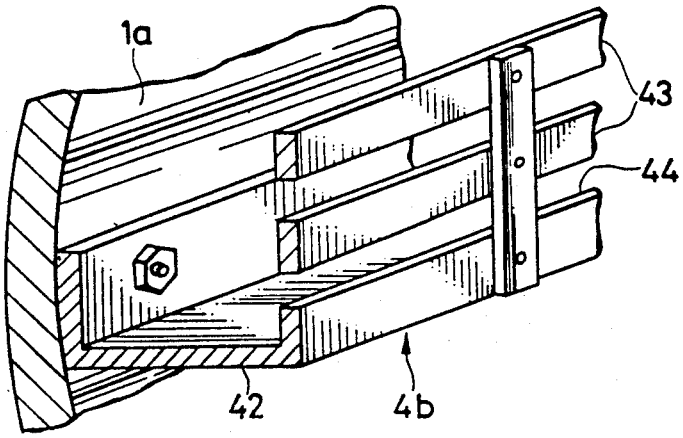
FIG. 4 is a perspective view of a part of the agitating blade.
Figure 5:
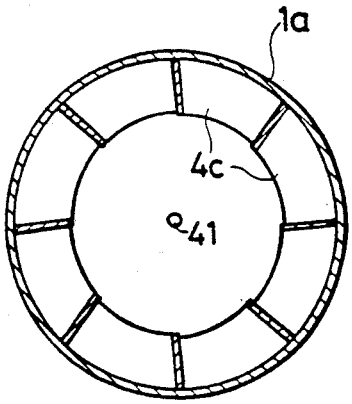
FIG. 5 is a cross sectional view showing the shape of nonreturn blades provided on the inner peripheral wall surface of an introduction port section of the cylindrical dryer.
Figure 6:
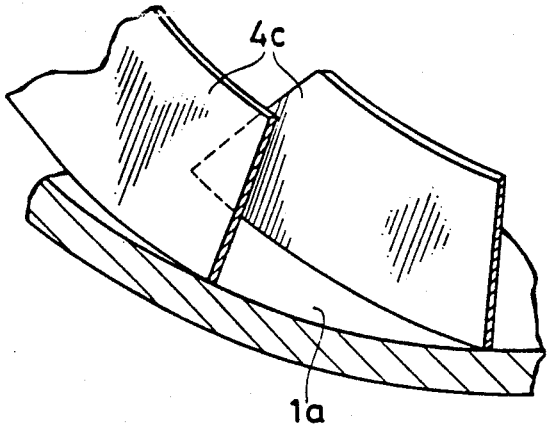
FIG. 6 is a perspective view of a part of the nonreturn blades.

The dryer 1 has a cylindrical rotary member **1*a* which is pivoted to a stationary lower end structure 1*b* and a stationary upper end structure 1*c* and which is driven to rotate by means of a drive mechanism 40. The stationary lower end structure 1*b* is provided with a discharge port 22 for discharging the new aggregate as well as with a burner 23 while, on the other hand, the upper end structure 1*c* is provided with an inlet port 21 for introduction of the new aggregate into the dryer 1 as well as with the exhaust duct 9. The rotary member 1*a* consists of three sections—a flame section located at the side of the burner 23, an introduction section located at the side of the inlet port 21, and an intermediate inner wall section located between those two sections. The flame section, the intermediate inner wall section and the introduction section are provided, on its cylidrical inner wall surface, with auxiliary blades 4*a*, agitating blades 4*b* and nonreturn blades 4*c*, respectively. The flame section, as shown in FIG. 2, is provided, on its cylindrical inner wall surface, with the auxiliary blades 4*a* having a substantially L-shaped cross section in such a manner that they are arranged in a manner extending from the cylindrical inner wall surface radially about a center 41 of the cylinder of the burner 23. The agitating blades 4*b* having a base 42 shaped, in cross section, like L, on which lateral plates 43 are fixed having gaps 44 therebetween. The introduction section, as shown in FIGS. 5 and 6, is provided, on its cylindrical inner wall surface, with the nonreturn blades 4*c* in such a manner that they are arranged in a manner extending from the cylindrical inner wall surface radially about the center 41** of the burner cylinder and being inclined with respect to an axis thereof.

The action of this embodiment will now be described below.

The respective mixing amounts of the new aggregate and the base material to be recycled are measured in the aggregate measuring tub 17 so as to bear a predetermined mixing weight ratio. Where the amount of the base material is too large, a recycled asphalt of good quality can not be obtained. For this reason, the following mixing weight ratios are experimentally set taking, for example, the particle size of the base material into consideration. That is, the new aggregate is selected to have a weight part of 90 to 40 whereas the base material to be recycled is selected to have a weight part of 10 to 60. For example, the base material is, selected, for being mixed with the new aggregate, to have a weight part of 10 when the weight part of the new aggregate is 90. Further, the base material is selected to have a weight part of 60 when the new aggregate has a weight part of 40. As stated before, the new aggregate is fed into the aggregate measuring tub 17 after it has been heated with the dryer 1 at a moderate predetermined temperature. On the other hand, the base material to be reproduced is fed in a state wherein it is kept at normal temperature. At the time of mixing those two types of material, desirably, the mixture is maintained at a temperature of 150° C. or more. Therefore, when the weight part of the new aggregate is 90, the new aggregate is heated at about 190° C. When the weight part of the new aggregate is 40, this aggregate is heated at about 350° C. Concerning the values of weight part falling within the intermediate range between 90 and 40, the setting thereof is performed while the gradient of change in weight part of from 90 toward 40 is brought into corresponding relationship to the gradient of rise in temperature of from 190° C. toward 350° C. While the base material to be recycled is fed in a state of having been kept at normal temperature as mentioned above, the content of water therein desirably is 2% or less. The upper limit of temperature of heating the new aggregate when the base material to be recycled is added 60% is 350° C. In order to heat the new aggregate up to a temperature higher than 350° C., it is necessary to improve the facility. Besides, the quality of a composite heated recycled asphalt material is likely to be degraded. For this reason, limitation inevitably is imposed upon the heating temperature for the new aggregate.

The above-mentioned mixture is thrown from the aggregate measuring tub 17 into the mixer 2 while, on the other hand, the new asphalt and stone powders as measured are also thrown from the asphalt measuring tub 18 and the stone powder measuring tub 19 into the mixer 2, whereby these materials are mixed with each other. It is to be noted that the new asphalt is added in an amount obtained by subtracting from an optimum amount of asphalt the amount obtained through multiplying the amount of asphalt extracted from the base material to be recycled by the percentage of asphalt to be mixed. During the time period in which the mentioned materials are mixed by means of the mixer 2, the heat exchange is performed between the new aggregate and the other materials. As a result, the mixture in the mixer 2 is maintained at a desired mixing temperature of about 150° C. Under the conditions wherein the mixture is kept at such a temperature, the filler bitumen in the base material to be recycled is allowed to transfer onto the surfaces of the new aggregate. Thus, a primary coating is effected. After the gas of ducts produced at this time has been exhausted, the new filler bitumen (asphalt and stone powders) is allowed to transfer onto the surfaces of the new aggregate. Thus, a secondary coating is effected. Thus, a heated recycled asphalt mixture is obtained. This asphalt mixture is of substantially the same quality as that of a new asphalt mixture and thus can be used for pavement of a road as it stands.

While the heated recycled asphalt mixture is produced as above through operation of the mixer 2, during the mixing operation a large amount of vapor, dust and blue smoking are generated. When such vapor, dust and blue smoking are leaked outside the apparatus, they will become a cause of air contamination. To prevent this leakage, the mixer 2 and measuring tubs 17, 18 and 19 are covered by use of the covering 27 as stated before. By so doing, the mentioned gas is sucked into the duct 15 by operation of the exhauster 16 and is introduced into the exhaust duct 9. Thus, after having its dust and the like removed by means of the filter 11, the gas is emitted from the chimney 14. The gas which is emitted by way of the duct 15 is controlled, in terms of the amount exhausted, by the operation of the automatic opening/closing device 7 adapted to automatically operate the opening/closing valve 8. That is to say, the automatic opening/closing device 7 is so constructed as to cause the opening/closing valve 8, which is automatically opened/closed by electric power or air, to be kept "open" for a specified period of time and at the same time to cause the exhauster 16 to rotate when the gas which contains vapor, dust and the like enters the interior of the covering 27. It is to be noted that, after said gas is exhausted into the duct, the opening/closing valve 8 is closed by use of, for example, a timer or the like in a specified period of time.

The new aggregate is introduced from the aggregate receptacle 20 into the dryer 1 by way of the introduction port 21 and is caused to rotate within the rotary member 1*a*. During the rotation step of this rotary member 1*a*, the nonreturn blades 4*c* function not only to prevent the new aggregate from being backwardly moved toward the stationary upper end structure 1*c* but also to cause the new aggregate to be transferrred to a central part of the interior of the dryer 1. The agitating or scarifying blades 4*b* function not only to upwardly scarify the new aggregate dropping onto the bottom zone of the inner peripheral wall surface of the rotary member 1 but also to allow the new aggregate to drop, as if it were hails, from the gaps 44 between the lateral plates 43 as it rises toward the top zone. The auxiliary blades 4*a* of the flame section function to scoop the new aggregate while it rises along the inner peripheral wall surface, so that the new aggregate is caused to rotate along the inner peripheral wall surface without being allowed to drop even at the top zone of the inner peripheral wall surface of the rotary member 1*a*. Thus, no new aggregate hinders the advance of the flame of the burner 23. Thus, the new aggregate is heated, while they are caused to rotate by the blades 4*a*, 4*b* and 4*c*, up to the above-mentioned temperatures (190° C. to 350° C.), thus to be discharged into the elevator 24 by way of the discharge port 22. Although a combustion gas which contains vapor, dusts, etc. is introduced into the dryer 1 from the burner, it is sucked and exhausted into the exhaust duct 9 by means of the exhausters 12 and 13 as stated before. In this case, the amount of the vapor produced within the dryer 1 varies depending upon the water content, etc. in the new aggregate. In order to increase the heat efficiency of the dryer, the material is preferably low in water content. More particularly the water content is required to be suppressed at 2% or less.

The exhaust-gas-amount controlling device 5 is disposed for the purpose of solving the above-mentioned problem. More specifically, the variation in internal pressure of the dryer 1 is sensed by the pressure sensor 3. Namely, the exhaust-gas-amount controlling device 5 is constructed such that, by sensing the internal pressure variations occurring due to the variations in quantity of the vapor in the dryer and the combustion gas sent thereinto from the burner 23, it controls the degree of opening of the opening/closing valve 6 in the exhaust duct 9 so as to make the level of the internal pressure approximately equal to the exteranl pressure. This prevents the unnecessary entry into the dryer of the above-mentioned cooling air, etc. It is to be noted in this connection that it is desirable to differ the internal pressure from the external one of the dryer 1 to an extent of minus 1 to minus several millimeters of water column. It is also to be noted that the pressure sensor 3 desirably is disposed at a position inside the dryer in the vicinity of the new aggregate discharge port 22 where the gas is most likely to stagnate. This is for the purpose of sensing the pressure with high accuracy at the position where the pressure has the greatest effect upon the property of the heated new aggregate as discharged. Besides, the exhaust-gas-amount controlling device 5 is connected to the exhausters 12, 13 as well so as to control the rate of exhaustion from the dryer in accordance with the degree of opening of the opening/closing valve 6. This prevents the dust from being leaked outside the dryer 1 and, at the same time, suppresses the degree of increase in pressure loss of the filter 11, etc. to enable the elongation of the service life.

As will be apparent from the foregoing description, the present invention has the following advantages.

(1) The asphalt mixture which contains the base material to be recycled and the new aggregate was compared with an asphalt mixture not containing any base material to be recycled but containing the new aggregate while the amount of the former material to be added was varied. The products obtained has uniform values involved, each of which cleared a reference value.

TABLE 1

| | Amount Added Of Base Material To Be Reporduced And The Results Of Test On The Physical Properties Of The Same | | | | | |
|---|---|---|---|---|---|---|
| | Comparison Example | Example No. 1 | Example No. 2 | Example No. 3 | Example No. 4 | Reference Value |
| Amount Added Of Base Material To Be Recycled (wt %) | 0 | 20 | 30 | 40 | 50 | — |
| Density (g/cm$^3$) | 2.392 | 2.400 | 2.412 | 2.411 | 2.422 | — |
| Void (%) | 4.0 | 4.0 | 3.7 | 3.8 | 3.5 | 3–6 |
| Stability (kg) | 1,160 | 1,260 | 1,360 | 1,390 | 1,380 | >750 |
| Flow Value (1/100 cm) | 25 | 25 | 30 | 29 | 29 | 20–40 |
| Dynamic Stability (times/mm) | 1,250 | 2,700 | 2,300 | 2,900 | 2,700 | >1,500 |

(2) By controlling the new aggregate feeding temperature in accordance with the variations in weight of the base material to be recycled, it is possible to obtain a good quality of asphalt mixture.

(3) It is possible to cause the internal pressure of the dryer to be kept at a specified unvaried level, thus enabling a stable desired and heated new aggregate to be fed to the mixer side. By controlling the amount of gas exhausted, it is possible to cause a decrease in required electric power of the exhausters, to cause a decrease in the amount of dust leaked from the dryer, and at the same time, to elongate the service lives of the filter, cyclone, etc.

(4) It is possible to heat the new aggregate uniformly and up to a predetermined temperature by providing the interior of the dryer with the mentioned blades.

(5) Effluence of no hot air from the dryer by way of the gaps or clearances takes place, so that unnecessary suction of cooling air into the dryer is prevented. As a result, it is possible to cause the heating efficiency to be kept at the highest level without being affected by the atmospheric temperature, weather, or other environmental conditions. And, (6) It is possible to prevent the dust, blue smoking, etc. generated when the mixer makes its kneading operation, from becoming cuases of the air pollution.

What is claimed is:

1. A method of producing a heated, recycled asphalt mixture, wherein a base material to be recycled and a new aggregate are mixed together in a mixer to produce a heated, recycled asphalt mixture, the base material being prepared by crushing a waste asphalt pavement material composed of filler bitumen and aggregate material, and the new aggregate being composed of crushed or broken stones, sands, asphalt and normal-temperature filler, said new aggregate being heated by a dryer up to an optimum temperature and introduced into the mixer, the method comprising the steps of selectively determining the mixing ratio of new aggregate to the base material to be recycled from the ranges of (90 to 40):(10 to 60) in terms of weight, setting the heating temperature for the new aggregate such that when the weight of the new aggregate is selected to be 90 percent, it is set at approximately 90° C. and that, as the selected weight of the new aggregate approaches 40 percent, the temperature is sequentially raised from 190° C. toward 350° C., the base material being maintained at all times at normal temperature while its water content is suppressed substantially 2 percent, mixing the new aggregate and the base material to be recycled in the mixer while both the new aggregate and base material are maintained to have a temperature ranging from 150° C. to 350° C. by way of heat exchange therebetween, thereby causing part of the filler bitumen in the base material to be recycled to be transferred onto the surfaces of the new aggregate to thereby form a primary coating, subsequently introducing new filler and new heated asphalt into the mixer, and kneading together the new aggregate, base material to be recycled, new filler, and new asphalt, thereby forming a new filler bitumen to be transferred onto the surfaces of the new aggregate to be recycled to thereby form a secondary coating.

* * * * *